US005233811A

United States Patent [19]

Odum et al.

[11] Patent Number: 5,233,811

[45] Date of Patent: Aug. 10, 1993

[54] MACHINE FOR INSTALLING A CARRIER ON BEVERAGE CANS AND THE LIKE

[75] Inventors: Thomas M. Odum, Zeigler; John R. Kopec, Thompsonville; Roger L. Eastwood, West Frankfort, all of Ill.

[73] Assignee: The Maston Corporation, Zeigler, Ill.

[21] Appl. No.: 931,919

[22] Filed: Aug. 18, 1992

[51] Int. Cl.[5] ..... B65B 27/04; B65B 21/00

[52] U.S. Cl. ..... 53/48.4; 53/556

[58] Field of Search ..... 53/397, 398, 399, 48.1, 53/48.3, 48.4, 441, 556

[56] References Cited

U.S. PATENT DOCUMENTS

| | | | |
|---|---|---|---|
| 3,383,827 | 5/1968 | Schaich | 53/398 |
| 3,383,828 | 5/1968 | Cunningham | 53/398 |
| 3,541,751 | 11/1970 | Quebe et al. . | |
| 3,628,305 | 12/1971 | Owen et al. | 53/48.4 |
| 3,959,949 | 6/1976 | Benno et al. . | |
| 3,968,621 | 7/1976 | Poupitch . | |
| 4,070,850 | 1/1978 | Cunningham | 53/48.4 |
| 4,121,712 | 10/1978 | Cunningham | 53/398 |

*Primary Examiner*—Horace M. Culver

[57] ABSTRACT

A machine which installs a carrier of elastic material having openings therein onto an end portion of an article such as a beverage can and the like. The machine moves the article generally forwardly relative to the carrier so that a leading edge of the end portion of the article engages the carrier along a portion of the periphery of one of the openings. The carrier is forced by a guide bar downwardly against the end portion of the article so that the carrier tends to be stretched and to be pushed onto the end portion of the article with the end portion being received in the opening. Fingers engaging the carrier in its openings operate cooperatively with the guide bar as the article moves forwardly relative to the carrier to force the carrier against the end portion. The fingers stretch the carrier laterally around the periphery of the end portion as the article moves forwardly relative to the carrier, generally following the contour of the article. The carrier is released by the fingers adjacent a trailing portion of the opening with the carrier resiliently contracting toward the unstretched configuration of the opening and gripping the end portion of the article for holding the article in the opening.

20 Claims, 8 Drawing Sheets

MACHINE FOR INSTALLING A CARRIER ON BEVERAGE CANS AND THE LIKE

BRIEF SUMMARY OF THE INVENTION

This invention relates generally to packaging machines and more particularly to a machine for installing a carrier on an article such as a beverage can and the like.

Soda, beer and other beverages sold in cans are frequently packaged in carriers consisting of a web of thin, flat plastic material having openings which receive the upper end of the cans. The web is resilient and grips the can in the opening for holding the can on the carrier so that several cans installed in respective openings in the carrier are supported by the carrier. Thus, the cans may be carried around by holding onto the carrier, rather than holding onto the cans. Presently, packaging in carriers is done at the canning plant, using substantial equipment which is too expensive for an independent store to own. However, a store owner may desire to package cans purchased in packages containing a large number of cans in smaller numbers in such a carrier. Manual installation, with or without a tool, is difficult and time consuming. Thus, there is a need for a machine to quickly and economically package cans in such a carrier.

Among the several objects and features of the present invention may be noted the provision of a machine for installing a carrier onto articles such as beverage cans and the like which operates automatically; the provision of such a machine which stretches the carrier to facilitate reception of the article therein; the provision of such a machine which requires little space to operate; the provision of such a machine which is selectively controlled to install the articles in the carrier in predetermined numbers; the provision of such a machine which is readily reconfigured for operation on articles of different sizes; the provision of such a machine which is economical to manufacture and easy to operate.

A machine constructed according to the principles of the present invention installs a carrier comprising a web of elastic material having openings therein onto an end portion of an article such as a beverage can or the like. Each opening of the web is smaller than the end portion of the article such that the web must be stretched to enlarge the opening for receiving the end portion. Generally, the machine comprises means for moving the article generally forwardly relative to the carrier web so that a leading edge of the end portion of the article engages the web along a leading portion of the periphery of one of the openings. Finger means adapted for engagement with the web in the opening operates as the article moves forwardly relative to the carrier web to force the web against the end portion. The finger means stretches the web laterally around the periphery of the end portion as the article moves forwardly relative to the web, generally following the contour of the article. The web is released by the finger means adjacent a trailing portion of the opening with the web resiliently contracting toward the unstretched configuration of the opening and gripping the end portion of the article for holding the article in the opening. The finger means reengages the web in an opening trailing the opening released such that the finger means is disposed for use in installing the carrier on a second article.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
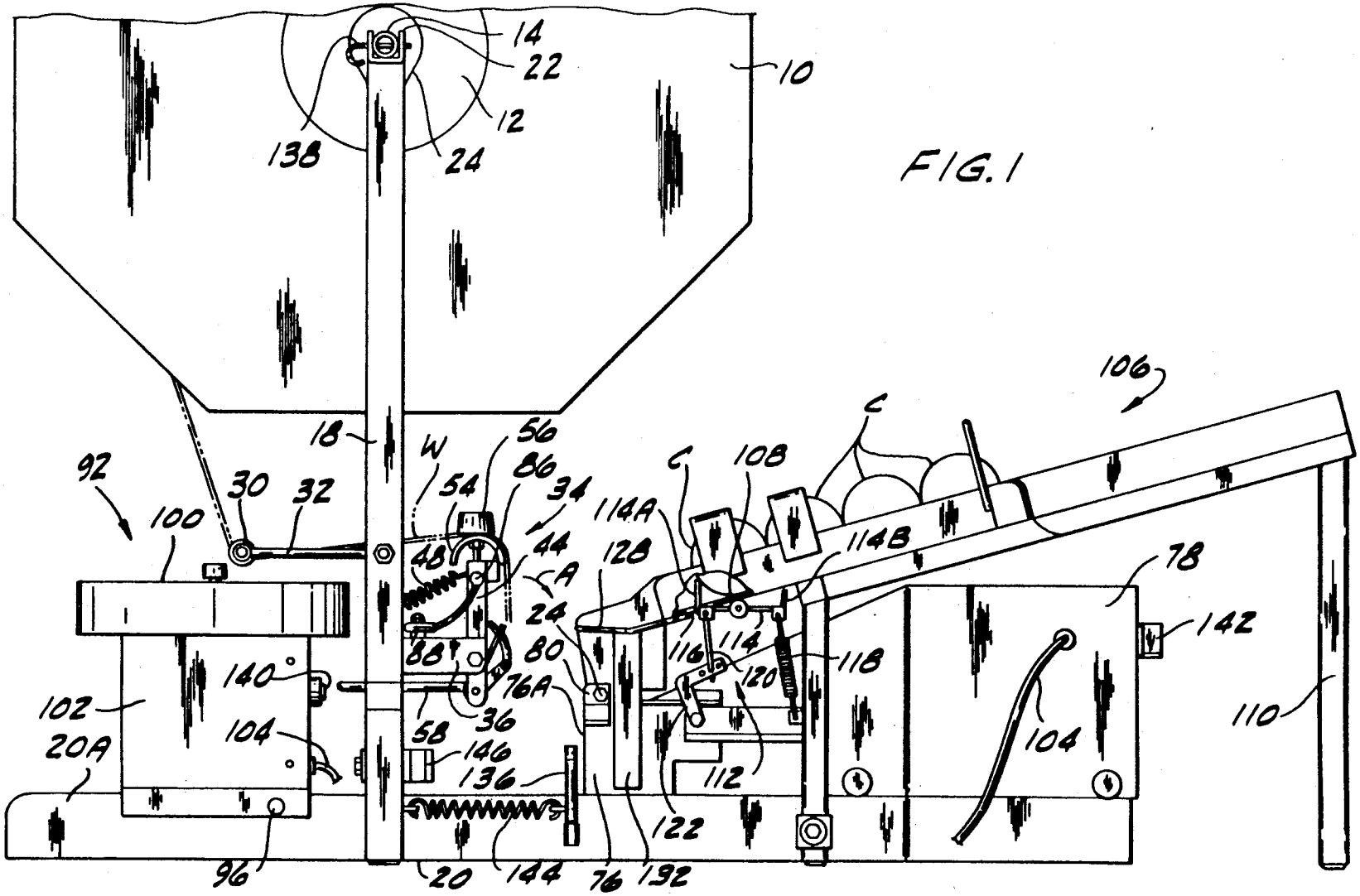
FIG. 1 is an elevation of the machine holding a spool of a carrier for installation on articles such as beverage cans, parts of the machine being broken away to show details.
Figure 5A:
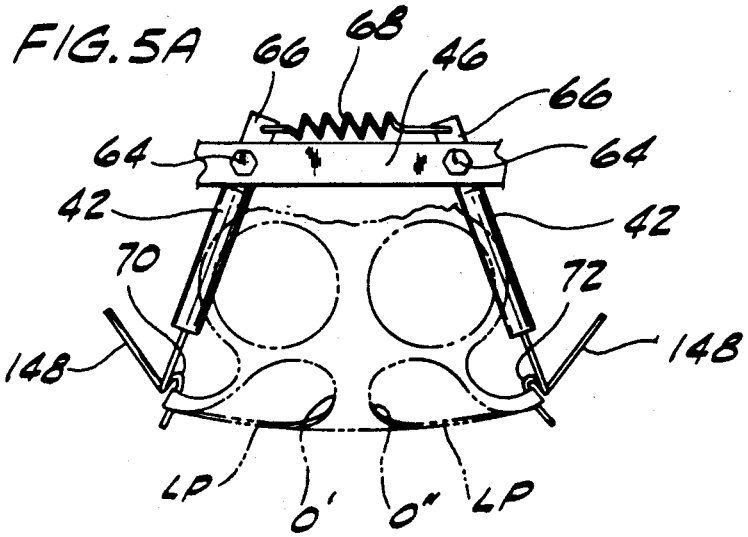
FIGS. 5A-5D schematically illustrate the sequence of carrier installation on beverage cans from the perspective indicated by line 3—3 of FIG. 1.

Referring now to the drawings, and in particular to FIGS. 1 and 5A, a carrier for an article such as a generally cylindrical beverage can C is shown to comprise a web W of resilient elastic material having openings O which are shaped for receiving an upper end portion U of the can. The openings O are arranged in pairs of laterally aligned openings spaced by a central portion of the web. In the relaxed configuration of the web W, each opening O has a circumference smaller than the circumference of the upper end portion U of the can C so that the web must be stretched to enlarge the opening for receiving the upper end portion. Once the can C is installed in one of the openings O, the resilient web W grips the can tightly and holds the can from falling out of the opening. As shown in FIG. 1, the carrier is supplied in a roll on a spool 10 supported on hubs 12 (only one is shown) mounted on an axle 14 extending through the center of the spool.

A carrier installing machine, indicated generally at 16, for installing the carrier onto the cans includes two stanchions 18 extending upwardly from a channel-shaped base 20 having side walls 20A and a bottom wall 20B extending between the side walls. The axle 14 is supported for rotation at the upper end of each stanchion 18. A disc-shaped extension 22 of the axle on one side of the spool 10 provides a friction surface along its circumference for use in resisting rotation of the spool. A belt 24 mounted on one of the stanchions 18 extends around the disc-shaped extension 22 and bears against it to resist rotation and unrolling of the web. Resistance to mounted by members 32 on the stanchions 18 and to the carrier installing mechanism indicated generally at 34.

Figure 3:
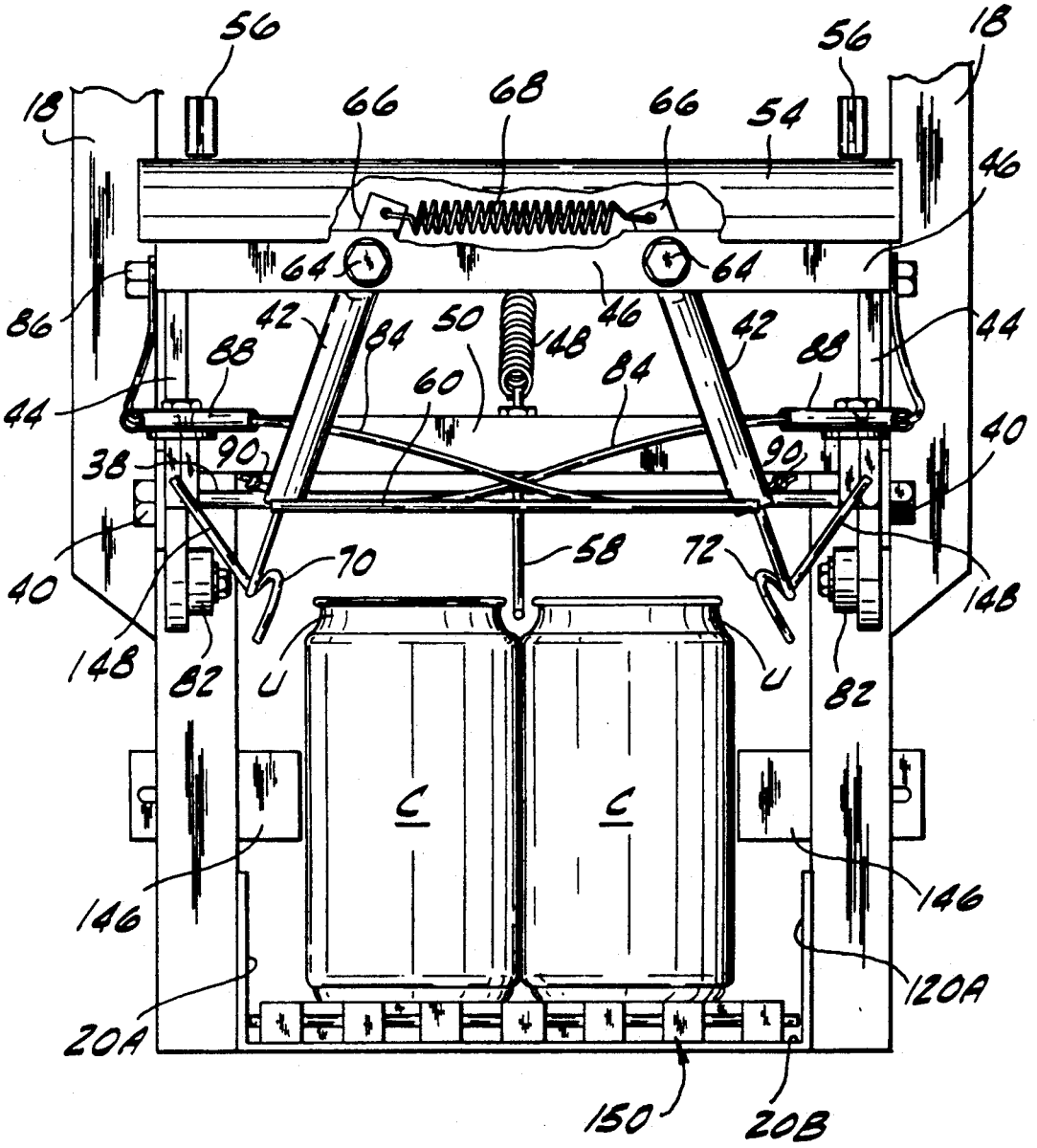
FIG. 3 is a section taken in the plane including line 3—3 of FIG. 1.

Referring now to FIG. 3, the carrier installing mechanism 34 includes struts 36 attached as by welding to respective stanchions 18 and extending rearwardly. A shaft 38 extending transversely of the machine 16 through the rearward ends of the struts 36 is attached by suitable fasteners 40 to the struts. The portion of the installing mechanism 34 mounting fingers 42 (to be described in more detail hereinafter) includes first and second laterally spaced members 44 and a cross piece 46 extending transversely between the distal ends of the members. The members 44 are mounted on the struts 36 by the shaft 38 which passes through an opening in each of the members and permits pivoting motion of the members and cross piece on the shaft about its longitudinal axis. A tension spring 48, attached to the cross piece 46 at one end and to a cross bar 50 extending between the stanchions 18 at its other end, biases the members 44 and cross piece 46 to the upright position shown in FIG. 1. A first guide 54 of inverted U shape in cross section extends transversely of the machine 16 and is mounted at the upper ends of the members 44 by studs (not shown) and knobs 56 threaded onto the ends of the studs. The web W extends over and partway around the first guide 54.

A guide bar 58 for guiding the carrier web W downwardly onto the cans C is attached as by welding to the top side of the cross bar 50. The guide bar 58 is shaped generally like a "J" laying on its back and extending rearwardly of the cross bar 50, with its butt portion curving upwardly and forwardly at its rearward end. A transversely extending second guide 60 is attached as by welding to the butt portion of the guide bar 58. The web W extends (as shown in FIG. 1) downwardly from the first guide, partway around the second guide 60 and thence forwardly. The guide bar 58 is disposed for engaging the middle portion of the web W between pairs of laterally aligned openings O carrier.

The fingers 42 are each mounted adjacent their respective upper ends to the cross piece 46 of the support frame at laterally spaced locations by suitable fasteners 64 for pivoting generally laterally about axes extending longitudinally of the machine 16. The top ends of the fingers 66 (above their point of mounting on the cross piece 46) are interconnected by another tension spring 68 which biases them toward their laterally outermost positions in which the lower ends of the fingers are spaced furthest apart. As shown in FIG. 5A, a generally hook-shaped portion 70 at the lower end of a first of the fingers 42 is adapted for engaging the carrier web W in one opening O' of the generally aligned pairs of openings O in the web along a laterally outward portion of the periphery of the opening. A similar hook-shaped portion 72 at the lower end of a second of the fingers is adapted for engaging the web W in the opposite opening O" of the laterally aligned pair of openings along a laterally outer portion of the periphery of the opposite opening. The fingers 42 biased by the tension spring 68 stretch the openings O', O" laterally outwardly.

Figure 7:
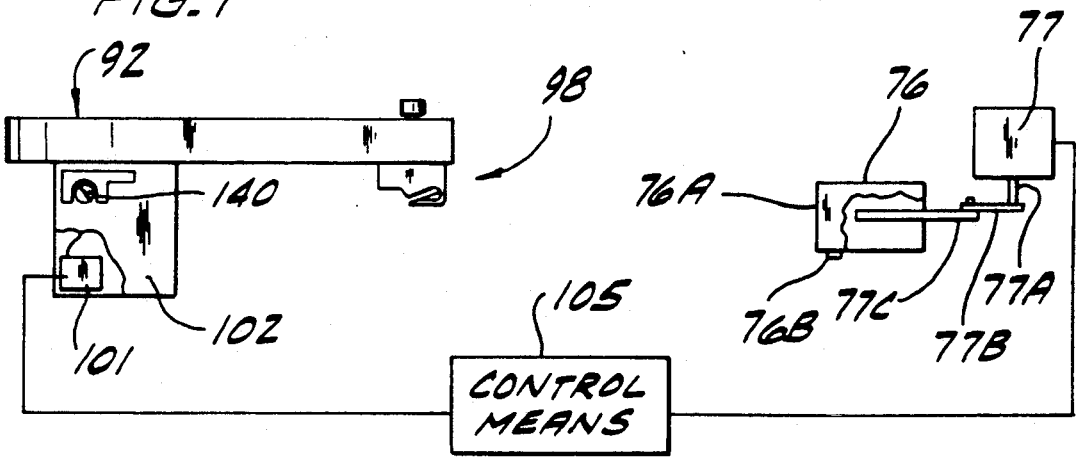
FIG. 7 is a schematic illustration of control means for the cutter.

A reciprocating drive arm 76 (broadly "moving means") of the machine 16 pushes the cans C generally in a forward direction relative to the carrier web W. The drive arm 76 is generally box-shaped and has a forwardly facing flat surface 76A adapted to simultaneously engage two of the cans C for pushing them forwardly. An electric motor 77 located in housing 78 at the rear of the machine has an output shaft 77A which is attached to the drive arm 76 by a first link 77B fixed to the shaft for conjoint rotation, and a second link 77C pivotally connected to the first, to convert the rotary motion of the shaft into the reciprocating motion of the drive arm (FIG. 7). Rollers 76B mounted on the drive arm 76 and riding on the bottom wall 20B of the base 20 support the drive arm at its forward end. The drive arm 76 is operable to simultaneously push leading edges of the upper end portions U of two cans into engagement with leading portions LP of the peripheries of respective openings O of the laterally aligned openings in which the fingers 42 are engaged (FIG. 5A).

Continued movement of the drive arm 76 and cans C causes the carrier web W to be forced downwardly and laterally outwardly around the upper end portion U of each can. Upstanding ears 80 mounted on the forward end of the drive arm 76 engage corresponding roller cams 82 mounted on the portion of the members 44 below the shaft 38. This engagement causes the members 44 and cross piece 46 of the carrier installing mechanism 34 to pivot rearwardly on the shaft 38 (in the direction indicated by arrow A in FIG. 1) from the initial upright position, against the bias of the tension spring 48, to a position in which the members are approximately 30 degrees from the horizontal. The pivoting action of the installing mechanism 34 causes the fingers 42, which are tethered to the struts 36 by cables 84, to pivot laterally inwardly on their connections to the cross piece 46. Each cable 84 is connected at one end by a bolt 86 to an upper end of one of the members 44 and extends through a curved, tubular cable guide 88 mounted on a respective strut 36 to the finger 42 farthest from the strut. The cables 84 and cable guides 88 constitute means for pivoting the fingers 42 laterally inwardly in this embodiment. As the members 44 and cross piece 46 pivot rearwardly as indicated by arrow A, the distance between the member and the cable guide 88 increases so that the cable is pulled through the cable guide toward the bolt 86. A stop 90 on the end of the cable 84 engages the finger 42 causing it to swing laterally inwardly. As explained more fully below, this action allows the fingers to release the web W after installation of the carrier on the cans C.

Figure 6:
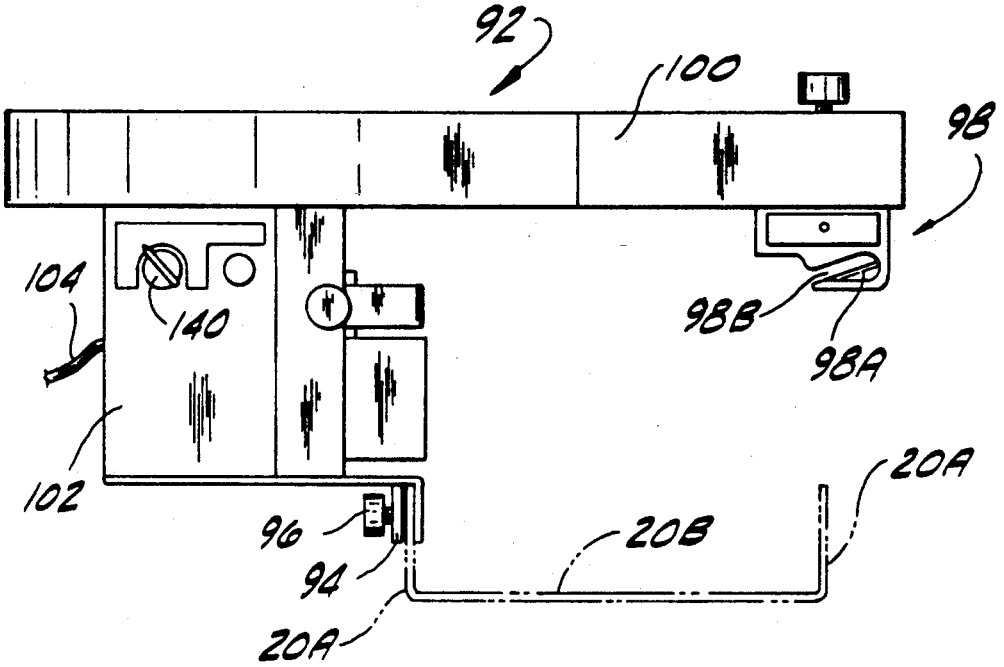
FIG. 6 is a section taken in the plane including line 6—6 of FIG. 1 showing a cutter.

The carrier installing mechanism 34 and drive arm 76 are operable to install the carrier web W on the upper end portions U of cans C continuously for substantially the entire length of the carrier web. To selectively sever portions of the carrier web W from the remainder of the roll after installation on a predetermined number of cans C an automatic cutter, generally indicated at 92, is mounted on one of the side walls 20A of the base of the machine 16. As shown in FIG. 6, a narrow channel 94 at the bottom of the cutter 92 receives an upper portion of the side wall 20A, and is releasably secured to the side wall at a selected location in a suitable manner such as by a set screw 96. The cutter 92 includes a knife, indicated generally at 98, mounted on a track 100 for motion transversely of the base 20. The knife 98 includes a blade 98A which is recessed in a slot 98B. The knife 98 is driven transversely over the base 20 by an electric motor 101 in a housing 102 which supports the track 100 and knife 98. The web W is received in the slot 98B as the knife moves over the base, and is severed by it engagement with the blade 98A. The electric motor 101 is releasably connected by a cord 104 to the housing 78 for receiving power. Through its plug-in connection, a sensor 105 (broadly "control means") counts the revolutions of the output shaft 77A and activates the motor 101 when the revolutions correspond to a predetermined number of cans C to be packaged together to sever the carrier web W. The motor 101 automatically cycles the knife 92 to return to its start position after the cut is made.

Figure 2:
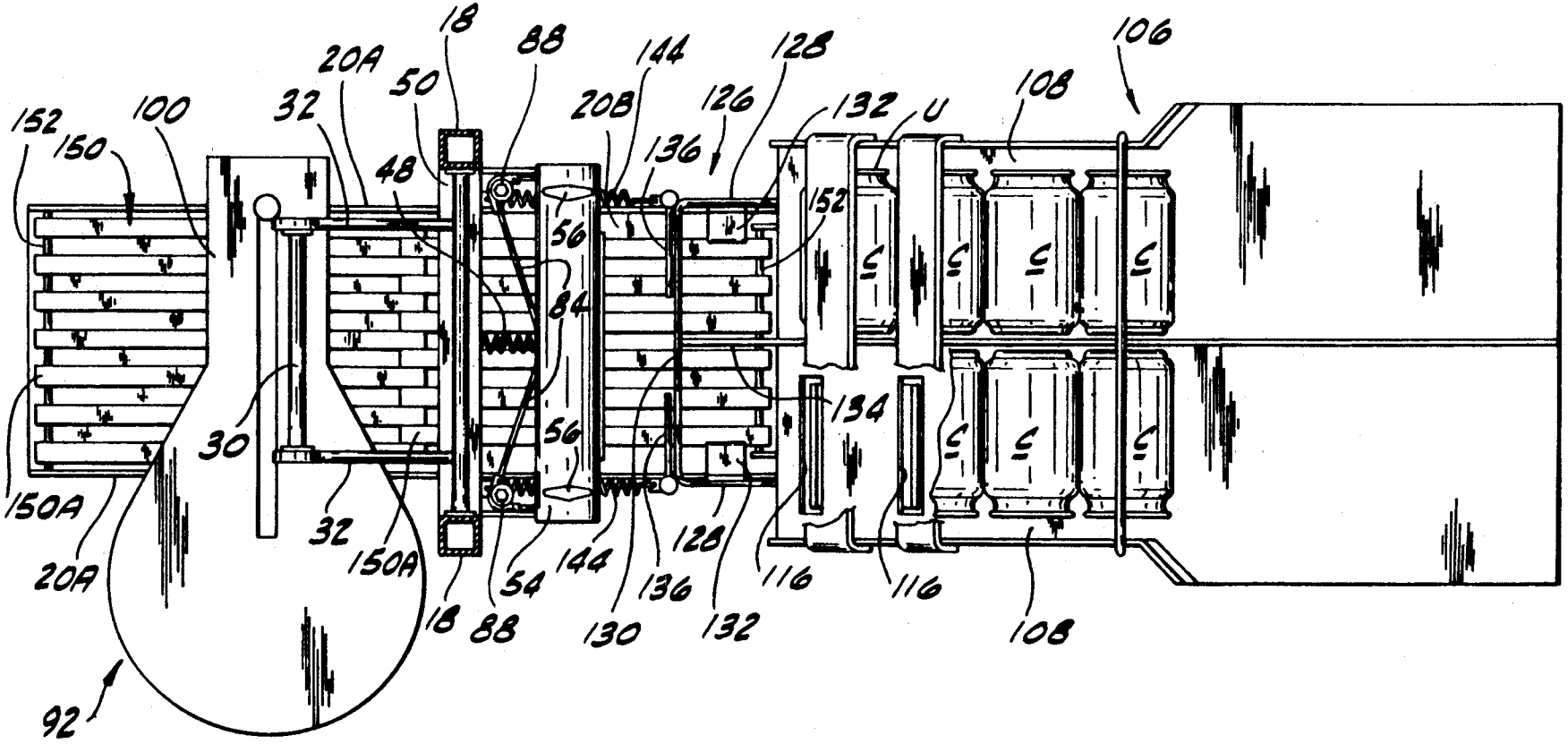
FIG. 2 is a plan view of the machine without the spool.

The machine 16 is constructed for holding a plurality of cans C on which the carrier is to be installed. An inclined rack indicated generally at 106 (broadly "means for delivering articles"), having two channels 108, is mounted on the base 20 generally above the drive arm 76 and housing 78. A leg 110 at the rear of the rack 106 supports a portion extending rearwardly of the base 20. Each of the channels 108 is wide enough to receive one of the cans C laying on its side so that it tends to roll down the rack 106 under the effect of gravity. As shown in FIG. 2, several of the cans can be loaded in a row in each channel 108. A gate mechanism, generally indicated at 112, adjacent the forward end of the rack 106 feeds the cans to the base 20 two at a time. The gate mechanism 112 includes a rocker arm 114 mounted on the underside of the rack for pivoting motion about an transverse axis. The rocker arm 114 has a pair of front gates 114A (one for each channel) at its forward end and a pair of rear gates 114B at its rearward end. Each of the gates 114A, 114B is receivable through one of four slots 116 (only two are shown) in the bottom of the rack 106 into one of the channels 108. The rocker arm 114 is biased by a spring 118 attached at one end to the rear of the rocker arm and at an opposite end to the base 20 to a position in which the rear gates 114B are withdrawn from their slots 116 and the front gates 114A protrude through their slots (i.e., the position illustrated in FIG. 1). In this position, the front gates 114A engage and hold respective rows of cans C from forward motion. The forward end of the rocker arm is attached by a link 120 to a lever arm 122 pivotally mounted on the base 20. The lever arm 122 has a camming portion engagable with another cam 124 mounted on and projecting laterally outwardly from the drive arm 76. Rearward motion of the drive arm 76 underneath the rack 106 causes the cam 124 to engage the lever arm 122 so that the rocker arm 114 pivots forwardly against the bias of the spring 118, thereby extending the rear gates 114B through their respective slots just behind the forwardmost cans C in the channels 108 and withdrawing the front gates 114A.

Once released by the front gates 114A, the forwardmost cans C roll off the end of the rack 106 and are turned upright by can erecting structure indicated generally at 126. The can erecting structure 126 for each channel 108 of the rack includes a forwardly extending side bar 128, a transversely extending front bar 130 and a rigid side flap 132 depending from the side bar. The front bar 128 is arranged to stop the forward motion of the can C and a center piece 134 prevents the cans from engaging each other after leaving the rack 106. The laterally outer (i.e., upper) portion of the can rolls onto and is supported by the side bar 128 while the laterally inner (i.e., lower) portion of the can is unsupported. Thus, the laterally inner portion of the can falls toward the base 20 ahead of the laterally outer portion so that the can pivots on the side bar 128 to an upright position. The side flap 132 is angled inwardly to guide the can toward the base 20. A pair of doors 136, one pivotally mounted on each side wall 20A of the base, retains the lower ends of the cans from sliding forward when they fall. The cans C are then positioned for engagement by the flat surface 76A of the drive arm 76. The cam 124 disengages the lever arm 122 upon forward motion of the drive arm 76, thereby releasing the rocker arm 114 to swing back to its position with the front gates 114A protruding through their slots 116 into the channels 108 and the back gates 114B withdrawn from their slots. The cans C in each channel 108 roll down so that the forwardmost cans engage the front gates 114A and are disposed for feeding to the base 20.

Operation

The operation of the machine 16 is better understood by reference to FIGS. 4A–4D and 5A–5D, schematically illustrating the operation of the carrier installing mechanism 34. To begin operation, a spool 10 holding a roll of the carrier web W is loaded with the ends of its axle 14 supported at the upper ends of the stanchions 18. The spool hubs 12 are secured in place by a cotter key 138 inserted through an opening adjacent one end of the axle 14. The belt 24 acts on the disc-shaped extension 22 of the axle to provide resistance to unwinding and maintain tension in the carrier web. The carrier web W is fed down from the spool 10 under the take-up bar 30 and thence forwardly over and partway around the first guide 54. The carrier web W is brought downwardly to the second guide 60 and partway around the second guide under the guide bar 58 to the hook-shaped portions 70, 72 of the fingers 42. One of the fingers 42 is received in one opening O' of a pair of laterally aligned openings O in the carrier web W with a portion of the web engaged in the hook-shaped portion 70 of the finger (FIG. 5A). The other finger 42 is received in the opposite opening O" with a portion of the web W engaged in the hook-shaped portion 72 of the opposite finger. The fingers 42 hold the leading portion of the web W and stretch the web and openings O', O" laterally outwardly.

Prior to initiating installation of the carrier on the cans, the cutter 92 is set by turning a control knob 140 on its housing 102 to the number of cans C desired in each package of cans on which the carrier web W is to be installed (e.g., six cans). Cans C are loaded on their sides into the rack 106 in two rows, one in each channel 108. The channels 108 are sized to receive cans of different heights. The cans 108 roll forwardly until the forwardmost cans engage the front gates 114A of the rocker arm 114. The machine 16 is now prepared to begin installing the carrier web W onto the cans C.

Pushing a control button 142 at the rear of the housing 78 activates the electric motor which starts to move the drive arm 76 rearwardly along the base 20. The cam 124 on the drive arm engages the lever arm 122 of the gate mechanism 112 and the rocker arm swings 114 forwardly releasing the forwardmost cans as described above. The forwardmost cans C in each channel 108 roll forwardly and fall down to the base, being set upright by the erecting structure 126 in front of each rack channel 108. The drive arm 76 reverses direction and the cam 124 disengages the lever arm 122 to permit the rocker arm 114 to swing to its spring biased position. The rear gates 114B are withdrawn from the channels 108 and the front gates 114A exposed so that the cans C in each channel roll down until stopped by the front gates.

Figure 4A:
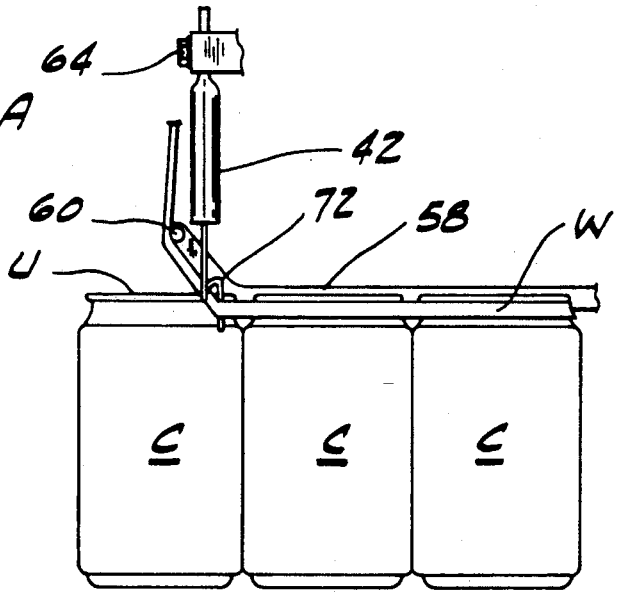
FIGS. 4A-4D schematically illustrate the sequence of carrier installation on beverage cans in side elevation.
Figure 4B:
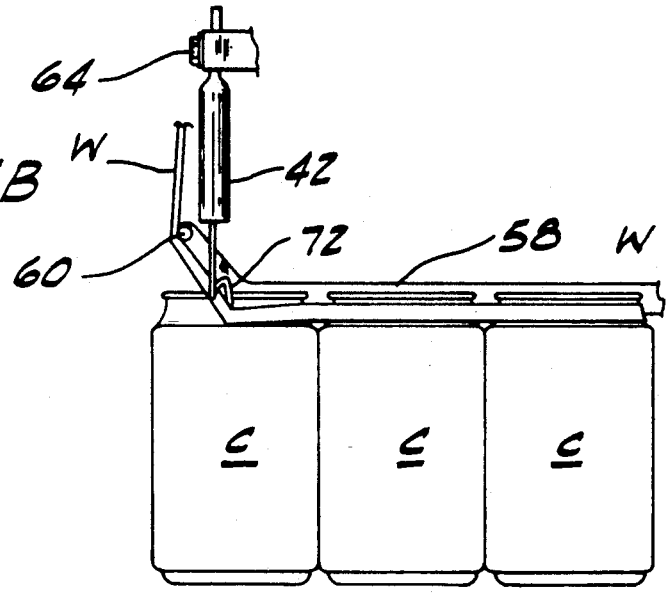
Figure 5B:
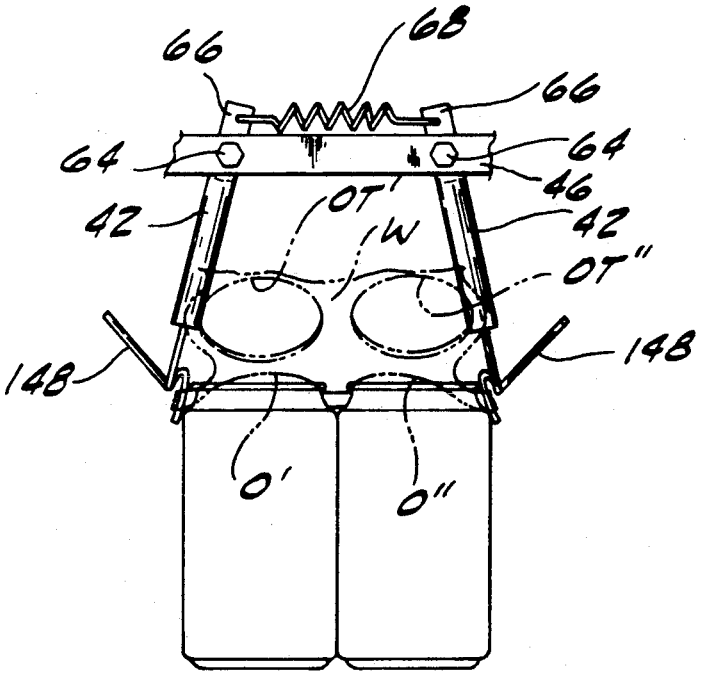

The drive arm 76 pushes the cans C through the doors 136, which swing open against the bias of springs 144, and toward the carrier installing mechanism 34. Leading edges of the upper end portions of the cans engage the carrier web W along leading portions LP of respective openings held by the fingers 42 (FIGS. 4A and 5A). As the cans C continue to move forward, they pull the web and thereby draw the fingers 42 inwardly into engagement with the forward facing upper portions U of the cans (FIGS. 4B and 5B). Thereafter, the cans push the fingers 42 laterally outwardly thereby enlarging the openings O by stretching the web laterally outwardly around the upper end portion U of the cans, generally following the contour of the can. The web W at the periphery of the openings O', O" slides over the fingers 42 as the cans, now in engagement with the web at leading portions LP of the peripheries of the openings, carries the web forwardly. At the same time, the cans C pass alongside the guide bar 58 which is disposed at a height above the bottom wall 20B of the base less than the height of the cans and which engages a central portion of the carrier web W between the laterally aligned openings. The guide bar 58 guides the web W downwardly relative to the cans and forces the web against the cans. The web W tends to stretch as the cans C are forced against it and to be pushed onto the cans with the upper end portions U of the cans received in respective openings O', O''. The hook-shaped portions 70, 72 of the fingers 42 are also located at a height lower than the height of the cans C so that they tend to force the web downwardly onto the cans as they pass alongside the fingers.

Figure 4C:
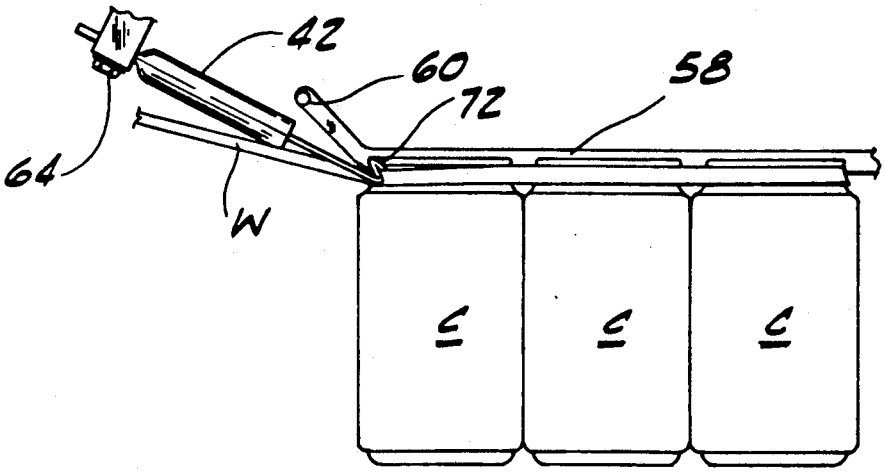
Figure 5C:
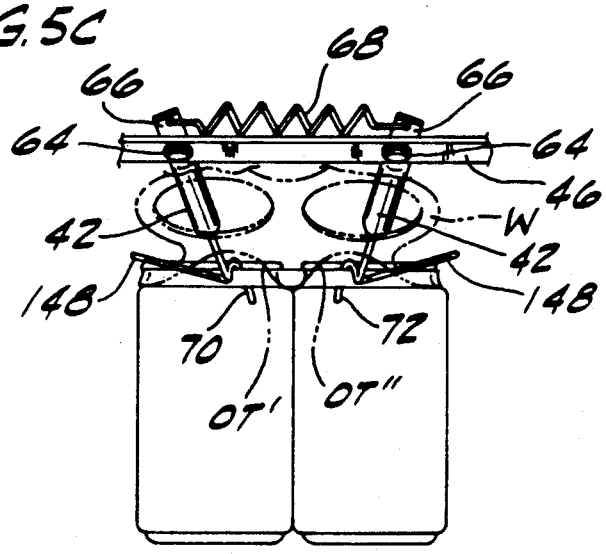

The ears 80 of the drive arm 76 engage the roller cams 82 and the lower ends of the members 44 of the carrier installing mechanism 34 causing the members, cross piece 46 and fingers 42 to swing forwardly (FIGS. 4C and 5C). At the same time the cables 84 tethering the fingers 42 to the members 44 cause the fingers to swing laterally inwardly generally at the trailing portion of the cans C and openings O', O''. At this point the cans C are subjected to significant forces which tend to cause the cans to move rearwardly and shift laterally in the base. Adjustable can guides 146 mounted on the stanchions 18 engage the cans C to prevent substantial lateral movement. The can guides 146 are adjustable laterally inwardly and outwardly so that the machine 16 may be set up to receive cans of different sizes. The reorientation of the fingers 42 caused by the movement of the support frame places the fingers in a nearly horizontal position for releasing the carrier web W, which slips out of the hook-shaped portions 70, 72 generally at a trailing portion of the opening. The web W resiliently contracts toward the unstretched configuration of the openings O and grips the upper end portions U of the cans C for holding the cans in the openings.

Figure 4D:
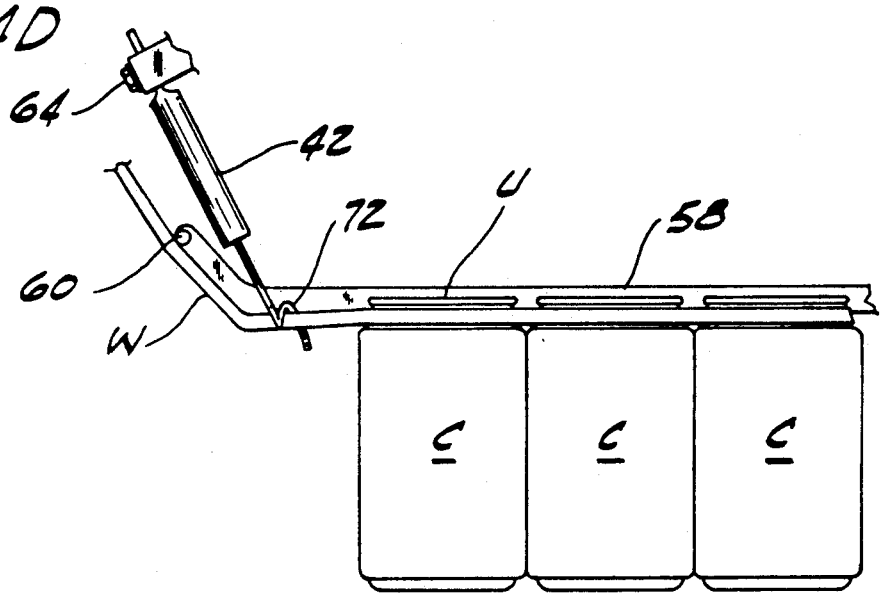
Figure 5D:
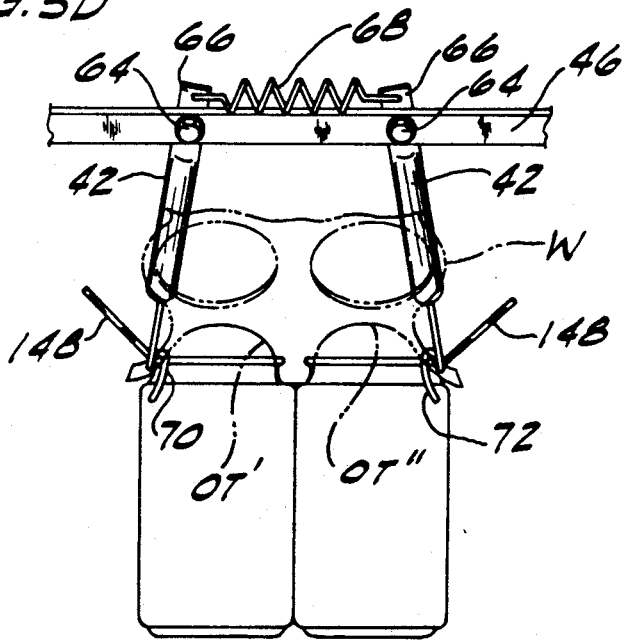

The drive arm 76 moves rearwardly, disengaging the roller cams 82 at about the same time the fingers 42 release the web and allowing the tension spring 48 to draw the fingers, members 44 and cross piece 46 of the installing mechanism 34 to their original upright position. The cables 84 are loosened allowing the tension spring 68 connecting the upper ends of the fingers 42 to swing them laterally outwardly away from each other as the support frame swings to its upright position. The carrier web W is held taut between the cans C and around the first and second guides (54 and 60, respectively). The arc of the hook-shaped portions 70, 72 of the fingers 42 as they swing outwardly brings them into respective openings OT', OT'' of a trailing pair of laterally aligned openings (FIGS. 4D and 5D). The hook-shaped portions 70, 72 catch the web W along a generally laterally outer portion of the periphery of these trailing openings toward the front of the openings and stretch the openings outwardly in preparation for receiving the next pair of cans. Guide rods 148 projecting generally rearwardly and upwardly from the hook-shaped portions 70, 72 help to guide the web into the hook-shaped portions. The guide rods 148 are not shown in FIGS. 4A–4D for clarity.

The drive arm 76 continues to move rearwardly, allowing springs 144 to swing the doors 136 to shut. Eventually, the cams 124 on the drive arm 76 re-engage the lever arm 122 of the gate mechanism 126 and a second cycle of operation begins. The second cycle of the apparatus includes the same operations (except the initial threading of the web and loading of the cans C into the rack) as the first, and results in a second pair of cans being installed in the trailing openings. As cans C continue to be packaged by the carrier, their number is counted by the sensor 105. When the preselected number of cans C has been counted, the electric motor 101 in the housing 102 is activated to move the knife 98 across the web W between pairs of cans to sever the portion of the web forward of the knife from the roll. The cans C are now packaged in an easy to carry number for sale.

As previously stated, the carrier installing machine 16 may be reconfigured to package cans C of different heights. It is important that the upper end portions U of the cans be located above the guide bar 58 and lower ends of the fingers 42. Therefore, if the cans C are shorter, a floor indicated generally at 150 on the bottom wall 20B of the base 20 is provided to raise them to the necessary height (FIG. 2). The floor 150 includes two sets of slats, designated 150A, 150B, respectively, each set of slats being connected together by a connecting rod 152 at one end thereof and free and the opposite end. The slats 150A, 150B have a thickness selected to raise the level of the upper end portions U of the cans to the necessary height. It is to be understood that several sets of slats may be provided for configuring the machine 16 for cans of several different heights. A first of the sets of slats 150A is installed over the bottom wall 20B with its connecting rod 152 connected to the drive arm 76 and the slats extending forwardly therefrom. A second of the sets 150B is positioned with its connecting rod 152 extending laterally between the side walls 20A at the forward end of the base. The slats of the second set 150B extend rearwardly from their connecting rod 152. The slats of each set 150A, 150B are spaced laterally of each other and arranged with respect to the slats of the other set so that upon forward movement of the drive arm and first set of slats 150A, the slats of both sets interdigitate. The construction of the floor 150 allows the first set of slats 150A to reciprocate with the drive arm 76 and yet provide a continuous surface to support the cans. The slats 150A, 150B are made of a smooth material such as graphite to prevent wear of the bottom wall 20A.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A machine for installing a carrier comprising a web of elastic material having openings therein onto an end portion of an article such as a beverage can and the like, each opening of the web being smaller than the end portion of the article such that the web must be stretched to enlarge the opening for receiving the end portion, the machine comprising:

means for moving the article generally forwardly relative to the carrier web so that a leading edge of the end portion of the article engages the web along a portion of the periphery of one of the openings;

finger means adapted for engagement with the web in the opening, said finger means holding the web at the opening so that the web is forced against the end portion of the article as the article moves forwardly relative to the carrier web, said finger means stretching the web laterally around the periphery of the end portion as the article moves forwardly relative to the web, said finger means generally following the contour of the article and releasing the web adjacent a trailing portion of the opening with the web resiliently contracting toward the unstretched configuration of the opening and gripping the end portion of the article for holding the article in the opening;

said finger means being constructed and arranged for reengaging the web in an opening trailing the opening released such that said finger means is disposed for use in installing the carrier on a second article.

2. A machine as set forth in claim 1 further comprising means for guiding the web in a direction generally perpendicular to the direction of movement of the article relative to the web against the end portion of the article, the web tending to be stretched as it is forced against the article and to be pushed onto the end portion of the article with the end portion being received in the opening.

3. A machine as set forth in claim 1 wherein said finger means is located for engaging the article as it moves forwardly, the engagement forcing said finger means to pivot laterally outwardly for stretching the web to enlarge the opening as the article moves forwardly.

4. A machine as set forth in claim 3 further comprising spring means for biasing said finger means to swing toward its laterally outwardmost position such that upon releasing the web at the trailing peripheral edge of the opening said finger means swings laterally outwardly into the trailing opening and engages the web along a generally laterally outer portion of the periphery of the trailing opening.

5. A machine as set forth in claim 4 further comprising means for pivoting said finger means laterally inwardly against the bias of said spring means as the rearward portion of the article passes said finger means, said finger means releasing the web upon said laterally inward pivoting with the opening in the web contracting around the end portion of the can to grip the can.

6. A machine as set forth in claim 5 wherein said finger means comprises a pair of fingers each pivotally mounted at one end on the machine, the fingers being located for engaging the web generally along the laterally outer periphery of two generally laterally aligned openings in the web, each of said fingers having a hook-shaped portion at its distal end to facilitate holding the web, the fingers each having a guide thereon for guiding the web into the hook-shaped portion upon release of the finger from its respective opening.

7. A machine as set forth in claim 2 wherein said web guide means comprises a bar located for engaging the web between the laterally aligned openings, the web being driven downwardly as it engages the bar thereby to force the web against the end portion of the article.

8. A machine as set forth in claim 1 further comprising a base supporting the article as it is driven forwardly relative to the carrier web by said moving means, and can guide means for restricting lateral movement of the article as the web is installed thereon.

9. A machine as set forth in claim 8 comprising a plurality of floors adapted to be selectively installed in the bottom of the base, each floor having a different thickness whereby the machine may be configured for installing the carrier on articles having different heights.

10. A machine as set forth in claim 1 further comprising means for holding a roll of the carrier web to permit unwinding of the web from the roll, said holding means being adapted to apply resistance to unwinding the roll.

11. A machine as set forth in claim 1 further comprising means for cutting the web transversely to separate a portion of the web installed on the articles from the roll of the web, and control means for controlling the cutting means operable to activate the cutting means upon installation of the web onto a predetermined number of articles.

12. A machine as set forth in claim 1 further comprising means for delivering articles two at a time to said moving means, said delivering means comprising a rack for holding two rows of articles laying on their sides, said rack being sloped forwardly so that articles are urged forwardly, first and second gates for each row of articles for holding the row from forward movement, the gates being located generally adjacent a forward end of the rack and being alternatively extensible into and retractable from the rack for permitting forward motion of the row or the forwardmost article in the row whereby one article at a time from each row is delivered to said moving means, and means for turning an article being delivered from the rack to an upright position.

13. A machine for installing a carrier comprising a web of elastic material having openings therein onto an end portion of articles such as beverage cans and the like, the openings being arranged in generally laterally aligned pairs along the length of the web and each opening being smaller than the end portions of the articles such that the web must be stretched to enlarge the opening for receiving the respective end portion, the machine comprising:

means for moving the articles generally forwardly relative to the carrier web so that a leading edge of the end portion of each article engages the web along a portion of the periphery a respective opening of a laterally aligned pair of the openings in the web;

a guide bar located for engaging the web between the laterally aligned openings, the web being guided downwardly as it engages the bar to a position below the end portion of the article such that the web is forced against the end portion of the article, the web tending to be stretched as it is forced against the article and to be pushed onto the end portion of the article with the end portion being received in the opening;

a pair of fingers a first of which is adapted for engaging the web in an opening of one of the generally laterally aligned pairs of openings in the web and a second of which is adapted for engaging the web in the opposite opening of said one generally laterally aligned pair of openings;

the fingers operating cooperatively with the guide bar as the article moves forwardly relative to the carrier web to force the web against the end portions, the fingers stretching the web laterally around the peripheries of the end portions of respective articles as the articles move forwardly relative to the web, the fingers generally following the contour of the articles and releasing the web adjacent a trailing portion of the openings with the web resiliently contracting toward the unstretched configuration of the openings and gripping the end portions of the articles for holding the articles in respective openings;

spring means for biasing the fingers to pivot laterally outwardly away from each other such that upon releasing the web at the trailing portion the openings each finger swings laterally outwardly into a respective opening of a laterally aligned pair of trailing openings and engages the web along a generally lateral portion of the periphery of the respective trailing opening so that finger means is disposed for use in installing the carrier on other articles.

14. A machine as set forth in claim 13 further comprising a base supporting the article as it is driven forwardly relative to the carrier web by said moving means, and can guide means for restricting lateral movement by the article as the web is installed thereon.

15. A machine as set forth in claim 14 comprising a plurality of floors adapted to be selectively installed in the bottom of the base, each floor having a different thickness whereby the machine may be configured for installing the carrier on articles having different heights.

16. A machine as set forth in claim 13 further comprising means for holding a roll of the carrier web, said holding means being adapted to apply resistance to unwinding of the roll.

17. A machine as set forth in claim 16 further comprising means for cutting the web transversely to separate a portion of the web installed on the articles from the roll of the web, and control means for controlling the cutting means operable to activate the cutting means upon installation of the web onto a predetermined number of articles.

18. A machine as set forth in claim 13 further comprising means for delivering articles two at a time to said moving means, said delivering means comprising a rack for holding two rows of articles laying on their sides, said rack being sloped forwardly so that articles are urged forwardly, first and second gates for each row of articles for holding the row from forward movement, the gates being located generally adjacent a forward end of the rack and being alternatively extensible into and retractable from the rack for permitting forward motion of the row or the forwardmost article in the row whereby one article at a time from each row is delivered to said moving means, and means for turning an article being delivered from the rack to an upright position.

19. A machine as set forth in claim 13 further comprising means for pivoting the fingers laterally inwardly against the bias of said spring means as the rearward portion of the article passes the fingers, the fingers releasing the web upon said laterally inward pivoting with the opening in the web contracting around the end portion of the can to grip the can.

20. A machine as set forth in claim 13 wherein the fingers each comprise a guide for guiding the web into the hook-shaped portion upon release of the finger from its respective opening.

* * * * *